US006166632A

United States Patent [19]

Chen

[11] Patent Number: 6,166,632

[45] Date of Patent: Dec. 26, 2000

[54] INTERACTIVE ALARM SYSTEMS

[76] Inventor: Tai-Sheng Chen, No.2, Alley 1, Lane 324, Tai Shan Rd., Yi Lan, Taiwan

[21] Appl. No.: 09/166,059

[22] Filed: Oct. 2, 1998

[51] Int. Cl.[7] ..... G08B 29/00

[52] U.S. Cl. ..... 340/506; 340/508; 340/533; 340/825.36; 340/825.49; 340/286.02; 379/45

[58] Field of Search ..... 340/506, 507, 340/508, 524, 525, 533, 825.36, 825.49, 286.02, 531; 379/45

[56] References Cited

U.S. PATENT DOCUMENTS

| | | | |
|---|---|---|---|
| 4,951,029 | 8/1990 | Severson | 340/506 |
| 5,103,206 | 4/1992 | Yu | 340/506 |
| 5,386,209 | 1/1995 | Thomas | 240/539 |
| 5,398,277 | 3/1995 | Martin et al. | 379/39 |
| 5,939,980 | 8/1999 | Heitmann et al. | 340/506 |

*Primary Examiner*—Daryl Pope

*Attorney, Agent, or Firm*—Harness, Dickey & Pierce, P.L.C.

[57] ABSTRACT

An interactive security system includes a host controller, a security service center coupled with the host controller to receive an emergency signal from the host controller, a client society comprising a client that consists of an auxiliary controller coupled with the host controller. An auxiliary controller includes a button and a lot of lights equal to the total number of the clients in the client society, wherein every client has an identification light indicating the client's number. The identification light is green in normal situation. When a client presses the button, a light indicating the identification of the emergency client's number illuminating with red on the every auxiliary controller of the client society. The alarm system of the auxiliary controller is turned on and in accordance with beep-beep sound and then transmits an emergency signal to the host controller. Finally, the host controller transmits the emergency signal to another auxiliary controllers that illuminate the red lights indicating the emergency client.

17 Claims, 4 Drawing Sheets

INTERACTIVE ALARM SYSTEMS

FIELD OF THE INVENTION

The present invention relates to a system for assuring security, and more specifically, to an interactive alarm system for informing a security institution.

BACKGROUND OF THE INVENTION

There are buildings and skyscrapers everywhere, and the relations become cold and estranged in the modern society. Property loss or injury to humans may be unavoidable when a robbery, a fire, an emergency, or a serious accident happens because reports or help are not immediately given. Therefore, current security systems are proposed for preventing the aforementioned tragedies from occurring, such as a 911 system provided by police stations, a security system provided by a private security service company or a commercial security system set up by the owner.

Referring to FIG. 1, a block diagram is shown which is illustrative of a private security system provided by a private security service company conventionally (abbreviated as a "PS" system). The processes of the PS system are as following: when an accident happens, a client 101 (9 clients are included in the FIG. 1) raises an alarm noise and then transmits an emergency signal to an exchanger 102 through a personal channel. The exchanger 102 processes the emergency signal and subsequently transmits to the private security service company 103. The private security service company 103 raises an alarm noise, displays and lists information to indicate the location and the identification of the client when the security service company 103 receives the emergency signal. Security guards are then dispatched to the client for support. However, every client requires a personal channel to couple with the exchanger 102, which further couples with the security service company 103 by multi-channels.

FIG. 2 shows a block diagram illustrative of a "911" system conventionally provided by police stations. The "911" system processes are as follows: When an emergency happens, a client 201 (8 clients are included in FIG. 2) transmits an emergency signal to an exchanger 202 through a telephone line. The exchanger 202 processes the emergency signal then transmits it to the police station 203. Therefore, the client 201 should dial the telephone number and talk to the operator of the police station while the emergency signal connects. The exchanger 202 couples with the police station by multi-channels, too.

FIG. 3 shows a block diagram of the commercial security system set up by the owner, such as jewelry shops (abbreviated as a "CS" system). When an emergency occurs, a client 301 (9 clients are included in FIG. 3) raises an alarm noise and transmits an emergency signal to a service center 302 through a personal channel. The service center 302 raises an alarm noise, displays and lists information to indicate the location and the identification of the client and then reports to police station when the service center 302 receives the emergency signal. Every client also requires a personal channel to couple with the service center 302.

When an emergency happens, the aforementioned security system all raises alarm noises to inform the security service company or police station, and then lists the required emergency information. However, all of the conventional security systems are one-way systems, which cannot feedback any emergency information to the other clients. Therefore, a need has arisen to disclose a new security system to overcome the disadvantages of the known systems.

SUMMARY OF THE INVENTION

The object of the present invention is to provide an interactive alarm system to inform a security institution. The interactive alarm system can raise an alarm noise immediately when an emergency occurs. A security institution can list the information including the time, location, and identification of the emergency client which are then informed by the interactive alarm system. Subsequently, the aforementioned information is sent back to another client or neighbors for support at once.

The other object of the present invention is to provide an interactive alarm system that can distinguish the clients and feedback the information to another clients so as to overcome the disadvantages of the conventional security systems.

The interactive security system of the present invention includes a host controller, a service center coupled with the host controller to receive an emergency signal from the host controller, and a client society which includes a client which consists of an auxiliary controller coupled with the host controller. The auxiliary controller includes an emergency button and a lot of lights equal to the total number of clients in the client society, wherein every client has an identification light indicating the client's number. Green and red lights indicate normal and emergency situations, respectively. When a client presses the emergency button, a light indicating the identification of the emergency client's number turns to red on every auxiliary controller in the client society. The alarm system of the auxiliary controller is turned on and in accordance with beep-beep sound and then transmits an emergency signal to the host controller. Finally, the host controller transmits the emergency signal to another auxiliary controllers that illuminate the red lights indicating the emergency client.

DETAIL DESCRIPTION OF THE PREFERRED EMBODIMENT

The present invention provides an interactive security system, which is used in client societies having a lot of clients. In a preferred embodiment, ten clients in a client society use the interactive security system, as shown in FIG. 4.

Figure 1:
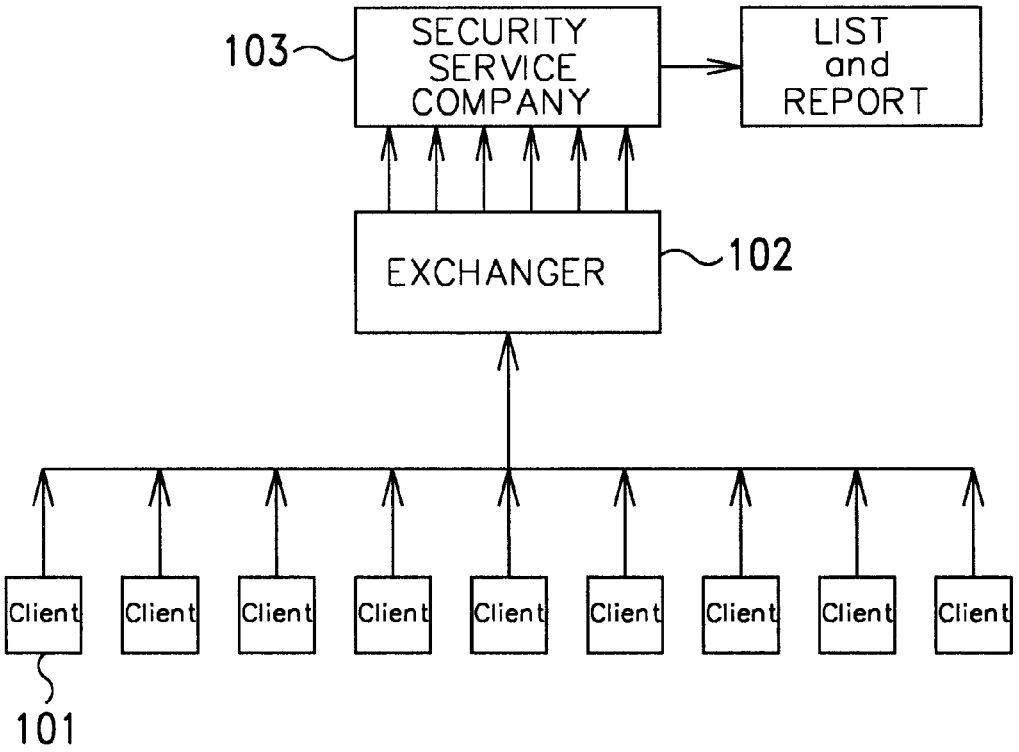
Fig.1 (PRIOR ART)
FIG. 1 shows a block diagram illustrative of a private security system provided by a private security service company.
Figure 2:
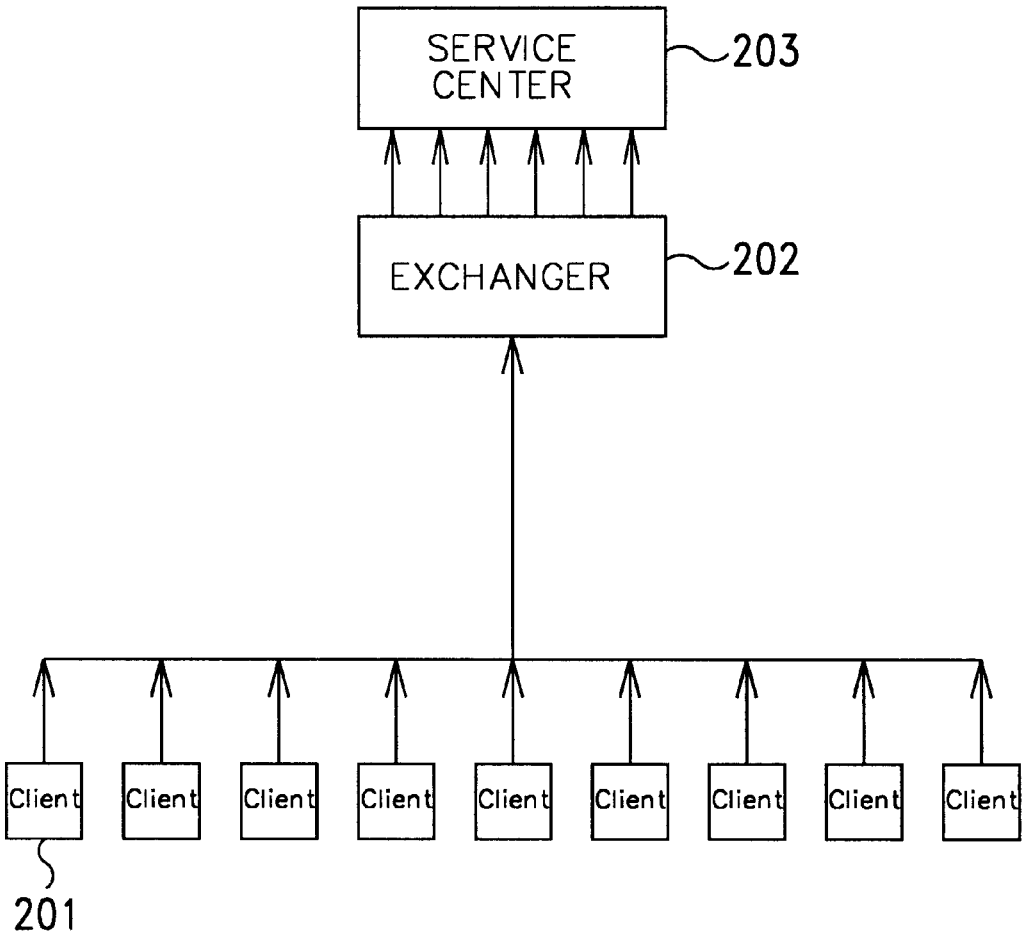
Fig. 2 (PRIOR ART)
FIG. 2 shows a block diagram illustrative of a "911" system provided by a police station.
Figure 3:
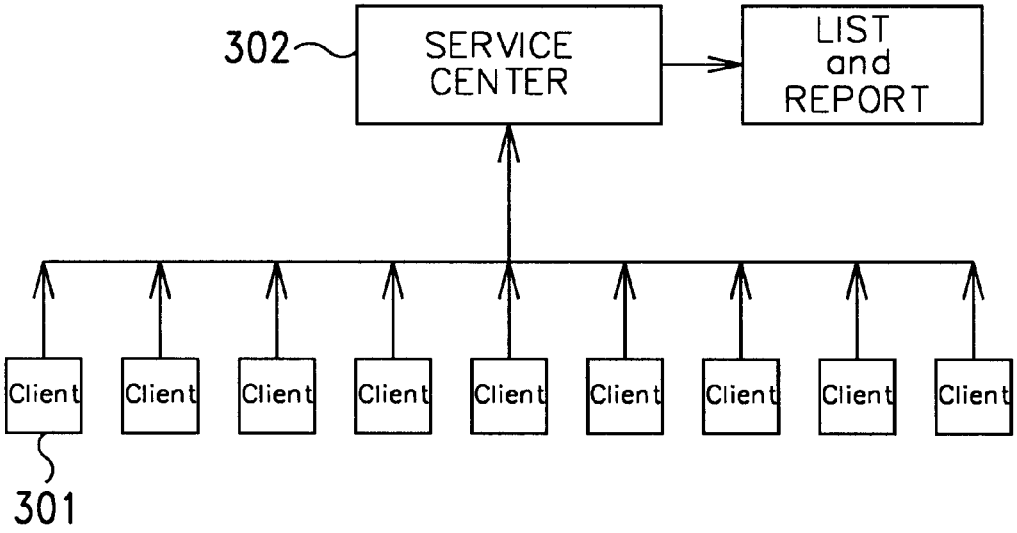
Fig. 3 (PRIOR ART)
FIG. 3 shows a block diagram illustrative of a commercial security system set up by the owner.
Figure 4:
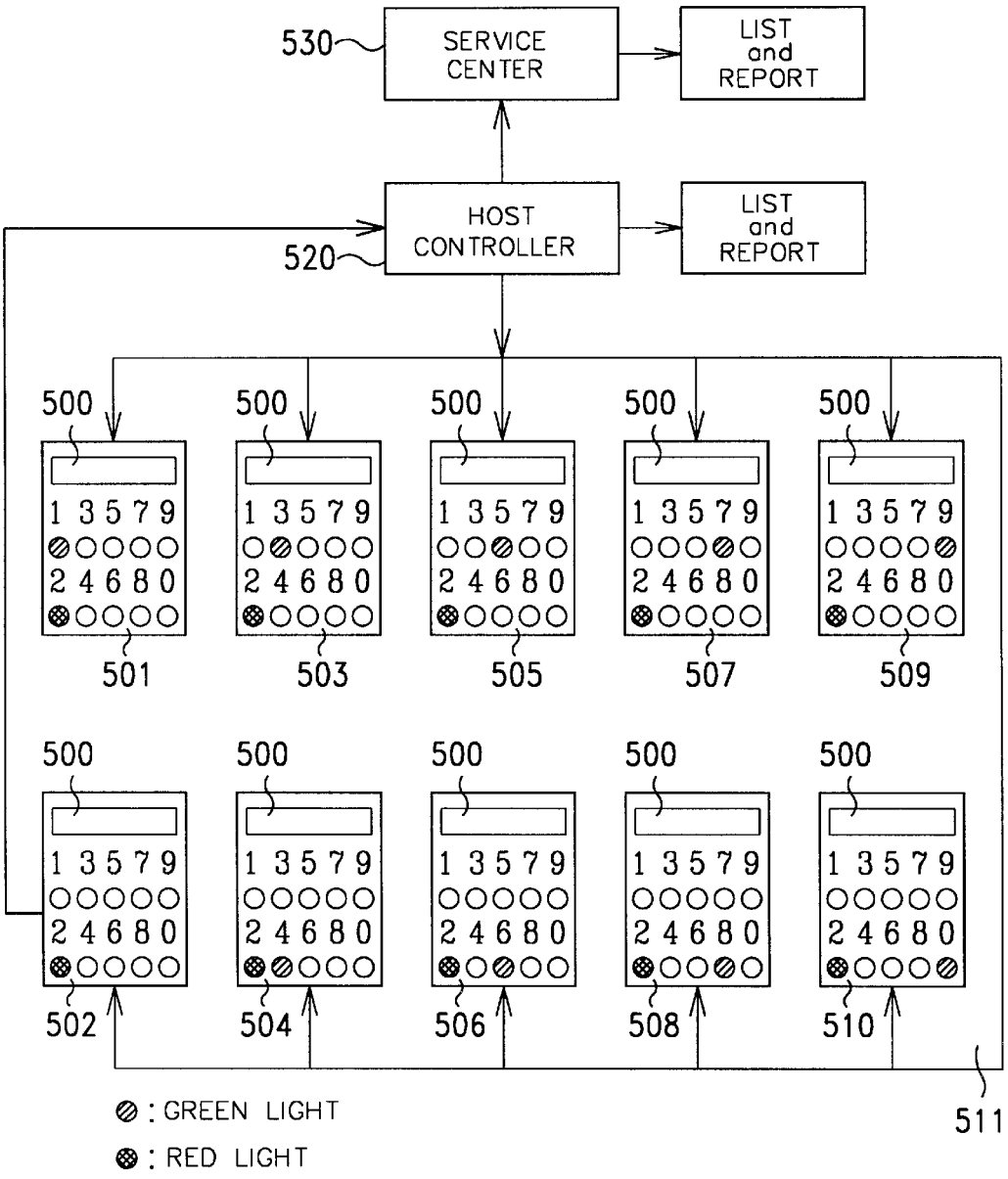
FIG. 4 shows a block diagram illustrative of an interactive security system of the present invention.

FIG. 4 shows a block diagram illustrative of an interactive security system of the present invention. The interactive security system encompasses a client society 511, which further includes ten auxiliary controllers 501~510. Each the auxiliary controller has an emergency button 500 and ten lights labeled 1, 2, 3, 4, 5, 6, 7, 8, 9, and 0 individually.

In a normal situation, each of the auxiliary controller 501 to 510 illuminates a green light in accordance with a label 1, 2 . . . 9 or 0. Namely the auxiliary controller 501 only illuminates the light labeled 1, the auxiliary controller 502 only illuminates the light labeled 2, the auxiliary controller 503 only illuminates the light labeled 3 and so on. A client can press an emergency button 500 when an emergency happens, then the identification light of the client will turn to red. Simultaneously, the auxiliary controller raises an alarm noise and transmits an emergency signal to a host controller 520. According to a preferred embodiment of the present invention, the host controller 520 sets up at a security service company or at a police station.

After the host controller 520 receives the emergency signal and raises an alarm noise at once, subsequently, the host controller 520 displays and lists the information, location, and the identification number of the emergency client. The host controller 520 informs another auxiliary controllers in the same client society automatically, and transmits an emergency signal to the service center 530. Then security guards are dispatched to the emergency client for help. After the service center 530 receives the emergency signal and raises an alarm noise at once, subsequently, the service center 530 displays and lists the information, location, and the identification number of the emergency client for reporting. Other auxiliary controllers receive the emergency signal and raise the alarm noise, and illuminate the red light labeled with the identification number of the emergency client. So, another clients in the same client society will understand where the emergency client is and can provide help immediately. In the preferred embodiment of the present invention, the connections between the auxiliary controllers 501~510 and the host controller 520, and between the host controller 520 and the service center 530 can be achieved by using telephone lines, optical fibers, or cables. The transmission distance is about 50 kilometers if using the telephone line, the time of transmitting a signal is about 6 seconds.

In a view of the above, the interactive security system of the present invention can raise an alarm noise immediately and inform a security institution when an emergency happens. Then the host controller 520 lists the information including the time, location, identification number, and the address of the emergency client, subsequently it informs the message back to another clients or neighbors to provide help at once. In addition, the interactive alarm system distinguish the clients and feedback the information to other clients.

As is understood by a person that skilled in the art, the foregoing preferred embodiment of the present invention is illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

While the preferred embodiment of the invention has been illustrated and described, it will be appreciated that various changes can be made therein without departing from the spirit and scope of the invention.

What is claimed is:

1. An interactive security system comprising:

a host controller;

a service center coupled with said host controller for receiving a signal from said host controller;

a client society including at least one client, wherein said client has an auxiliary controller coupled with said host controller for transmitting and receiving emergency signals, said auxiliary controller comprising one button and a plurality of lights equal to a total number of said clients included in said client society, wherein one of said lights is used as an identification light that indicates a current state, said, identification light illuminating a first light when said button has not been pressed, said identification light illuminating a second light in combination with a first alarm noise after said button has been pressed, after receiving said emergency signal from said host controller, said identification light of another clients in said client society illuminating said second light in combination with a second alarm noise to indicate which one of said clients has pressed said button.

2. The interactive security system according to claim 1, wherein a telephone line is used to couple said host controller coupled with said auxiliary controller.

3. The interactive security system according to claim 1, wherein an optical fiber is used to couple said host controller coupled with said auxiliary controller.

4. The interactive security system according to claim 1, wherein a cable is used to couple said host controller coupled with said auxiliary controller.

5. The interactive security system according to claim 1, wherein said emergency signal is transmitted to said host controller when said button is pressed.

6. The interactive security system according to claim 5, wherein said host controller receives said emergency signal and lists an information of said client pressing said button.

7. The interactive security system according to claim 6, wherein said list comprises a time, a location, and an identification number of said client.

8. The interactive security system according to claim 5, wherein said host controller receives said emergency signal and generates a third alarm noise.

9. The interactive security system according to claim 5, wherein said host controller receives said emergency signal and transmits said emergency signal to a service center.

10. The interactive security system according to claim 9, wherein said service center receives said emergency signal and lists an information of said client pressing said button.

11. The interactive security system according to claim 10, wherein said list comprises a time, a location, and an identification number of said client.

12. The interactive security system according to claim 9, wherein said service center receives said signal and generates third alarm noise.

13. A method for informing security institution of an interactive alarm system, said method comprising the steps of:

pressing a button of an auxiliary controller to generate a first alarm noise;

transmitting an emergency signal to a host controller from said auxiliary controller;

listing a reporting information when said host controller receives said emergency signal;

transmitting said emergency signal to a service center from said host controller;

transmitting said emergency signal from said host controller to other auxiliary controllers whose buttons have not been pressed;

listing said reporting information when said service center receives said emergency signal; and generating second alarm noises when said other auxiliary controllers receive said emergency signal.

14. The method according to claim 13, wherein said host controller generates a third alarm noise when said host controller receives said emergency signal.

15. The method according to claim 13, wherein said reporting information comprises a time, a location and an identification number of said auxiliary controller.

16. The method according to claim 13, wherein said service center generates a third alarm noise when said service center receives said emergency signal.

17. The method according to claim 13, wherein said reporting information is used for informing a security institution.

* * * * *